US006382620B1

(12) United States Patent
Gaarder et al.

(10) Patent No.: US 6,382,620 B1
(45) Date of Patent: May 7, 2002

(54) SINGLE SHEET FEEDER WITH ANGLED MULTI-SHEET RETARD PAD

(75) Inventors: Glenn Gaarder, Ramona; Michael Gustafson, San Diego, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/811,206

(22) Filed: Mar. 16, 2001

(51) Int. Cl.[7] ..... B65H 3/06
(52) U.S. Cl. ..... 271/117; 271/145
(58) Field of Search ..... 271/117, 118, 271/145

(56) References Cited

U.S. PATENT DOCUMENTS 3,063,711 A * 11/1962 Springer ..... 271/117
3,306,491 A * 2/1967 Eisner et al. ..... 271/117

FOREIGN PATENT DOCUMENTS

JP 61-243736 A * 10/1986 ..... 271/117
JP 2-152832 A * 6/1990 ..... 271/117
JP 404016428 A * 1/1992 ..... 271/117

* cited by examiner

*Primary Examiner*—H. Grant Skaggs

(57) ABSTRACT

A single sheet feeder for moving individual sheets from the top of a stack includes a driven sheet separator roller mounted on an arcuately moveable support arm, the roller having an annular sheet engaging friction surface and a bottom sheet retard pad in opposed relationship to the separator roller. In a first embodiment the retard pad has a specially configured sheet engaging surface having a sheet retarding portion which is angled downwardly from the direction of sheet movement to reduce excessively high separator roller drive torque requirements. In a second embodiment, the sheet support surface has a recess proximate the sheet retard pad for receiving the driven separator roller to prevent contact of the driven roller with the sheet support to avoid excessively high separator roller drive torque. Arcuate movement of the roller toward the sheet support is arrested by contact of the roller support arm with any suitable part of the sheet feeder chassis such as the retard pad or stack. support surface before the driven roller contacts the support surface.

19 Claims, 2 Drawing Sheets

SINGLE SHEET FEEDER WITH ANGLED MULTI-SHEET RETARD PAD

BACKGROUND OF THE INVENTION

The present invention relates generally to the art of paper and document handling for computer controlled printers, document scanners, automatic document feeders and other applications and, more particularly, to apparatus capable of separating single sheets from a stack thereof.

Automatic document processing apparatus such as scanners and desktop printers typically includes a shelf or tray for holding a stack of one or more sheets of documents to be scanned or blank paper or other media to be fed, one sheet at a time, to the other portions of the document processing apparatus. An example of a typical prior art single sheet separator is schematically shown in FIG. 1 in side elevation view for handling a stack of paper or printed documents to be processed. As shown, the stack S is horizontally oriented but persons skilled in the art will appreciate that the paper stack or holding tray may be inclined from the horizontal so as to feed sheets from the top of the stack to the single sheet separator mechanism with the assist of gravity. The prior art single sheet separator comprises a single sheet separator roller 10 rotatably mounted near the end of a support arm 20 which in turn is pivotally connected to support structure 30 such as the chassis of the document handling apparatus. The separator roller 10 has an arcuate surface textured for frictionally contacting the leading edge upper surface of the topmost one of the stack of sheets for moving the sheet to the left into engagement with an upwardly inclined multi-sheet separator wall 32. A multi-sheet retard pad 40 which has a flat surface having a coefficient of friction designed for holding the lowermost sheet in the stack to minimize multi-sheet picks of the last few sheets is also provided. In other words, the coefficients of friction of the retard pad 40 and the separator roller 10 are selected, as is well known in the art, in accord with the type and surface coefficient of friction of the individual media sheets to be handled which may be paper, vellum, transparencies, or other types of media. Typically, the stack S is supported on a support surface or tray 50. The pivot point 22 of the support arm 20 (which may be two or more spaced arms respectively positioned at opposite axial ends of the separator roller or rollers) may be downwardly biased by a spring 60 which provides a known amount of force urging the separator roller 10 toward the stack S. Rotary power may be imparted to the separator roller through a train of gears 12, 14, 16, 18 as shown or through any other suitable form of power transmission. It will be noted that the pivot point of the support arm is necessarily located above the stack of sheets to be handled due to space limitations and the usual configuration of the document handling apparatus. The single sheet retard pad 40 is ordinarily angled downwardly (to the right as shown) at an angle a from the horizontal to ensure that the leading edge of the last sheet or last few sheets in the stack of media does not engage the side edge of the retard pad 40.

Due to differences in the coefficients of friction of the sheets of media and of the media engagement surface of the retard pad, excessively high separator roller drive torque loads are experienced when the last sheet of media has been discharged from the system. This high torque condition is known to frequently cause irrecoverable printer errors. Potentially, the applied drive torque is no longer adequate to rotate the separator roller causing potentially self-locking of the separator roller.

A further problem is excessive high gain, which is the ratio of the total frictional force opposing movement of the sheet divided by that portion of the frictional force which is imparted by rotation of the separator roller 10, as will be explained. High gain results in unpredictable forces applied normal to the surface of the sheets of media and resultant unpredictable sheet separation performance. High gain is also known to cause great variation in the normal force exerted by the separator roller downwardly toward the retard pad 40 depending on the coefficient of friction between the separator roller and the type of media sheets in use.

It is, accordingly, an objective of the present invention to overcome the above noted problems in the typical prior art structures.

SUMMARY OF THE INVENTION

The present invention therefore provides a single sheet feeder for moving individual sheets from the top of a stack thereof comprising: a support surface for said stack, a driven sheet separator roller having an annular sheet engaging friction surface, a last sheet retard pad in said support surface in opposed relationship to said friction surface for retarding movement of the bottom sheet in the stack to minimize multi-sheet picks, and a roller support pivotally connected to chassis structure, said separator roller being rotatably mounted on said roller support and said separator roller being moveable and biased toward said support surface and said sheet retard pad, said sheet retard pad having a sheet engaging friction surface including a portion downwardly inclined from the direction of movement of sheets from said stack, said sheet separator roller being arcuately moveable toward said downwardly inclined portion of said retard pad.

The present invention further provides a single sheet feeder for moving individual sheets of media from the top of a stack thereof comprising: chassis structure including a media stack support having a stack support surface, a driven sheet separator roller having an annular sheet engaging friction surface, a last sheet retard pad recessed in said support surface and having a sheet engaging friction surface forming part of said support surface positioned proximate said separator roller for retarding movement of the bottom sheet in the stack to minimize multi-sheet picks, and a roller support pivotally connected to chassis structure, said separator roller being rotatably mounted on said roller support and said separator roller being moveable and biased toward said support surface, said stack support surface having a roller reception recess proximate said retard pad, said sheet separator roller being arcuately moveable toward said recess in said stack support surface, and arcuate movement of said roller support and roller being terminated before said roller engages said stack support surface in said recess by contact of said roller support with said chassis structure.

DETAILED DESCRIPTION OF THE PREFERRED EMBODIMENTS

Figure 1:
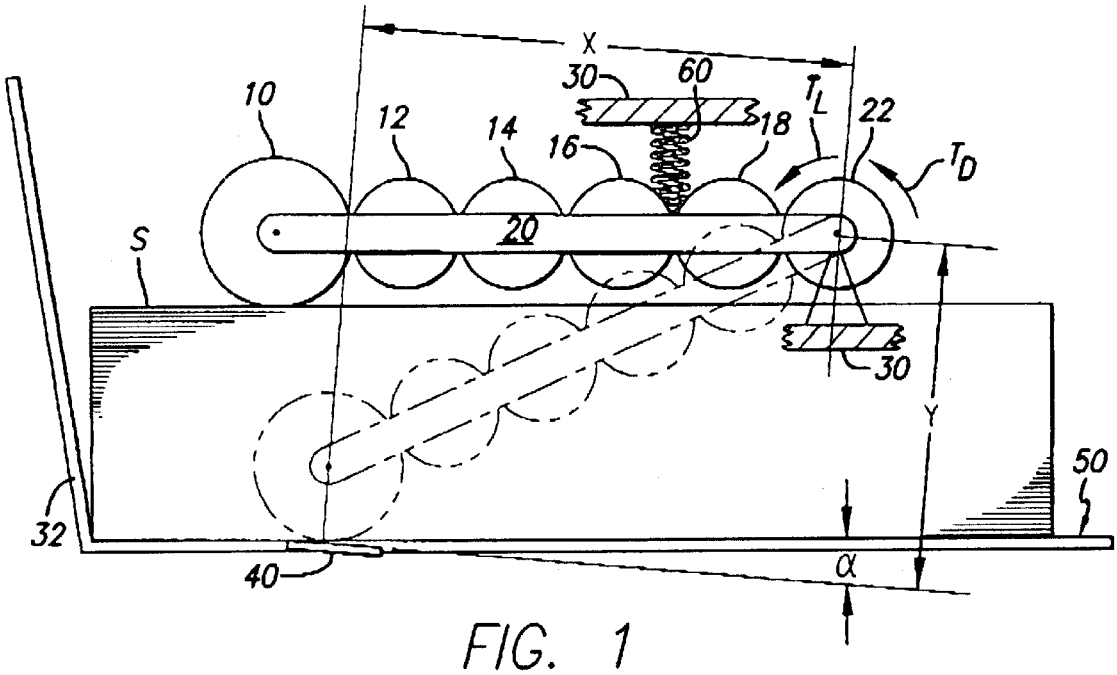
FIG. 1 PRIOR ART
FIG. 1 is a schematic side elevation view of a typical prior art single sheet feeder.

As seen in FIG. 1 which comprises a typical prior art arrangement, the geometric constraints of the apparatus require the pivot point 22 of the roller support arm 20 to be above the highest elevation of the media input stack. For reference purposes, X is defined as the distance from the contact point (when a sheet is not present in the nip) of the separator roller 10 with the retard pad 40 measured in a direction co-linear with the flat surface of the retard pad 40 to a line orthogonal to the direction in which the distance X is determined that passes through the pivot point 22 of the support arm 20. Y is the distance from the pivot point 22 orthogonal to the X direction, to a line aligned with the flat surface of the retard pad 40.

Figure 2A:
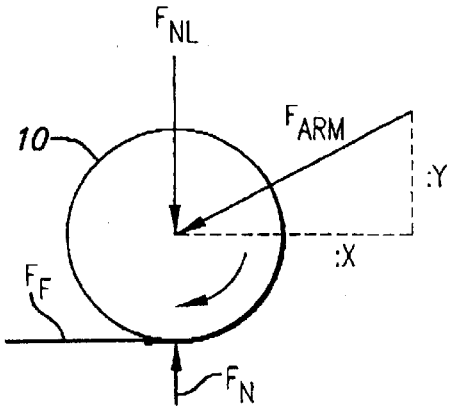
FIGS. 2*a* and 2*b* respectively show a free body diagram of a sheet separator roller and a vector resultant diagram.
Figure 2B:
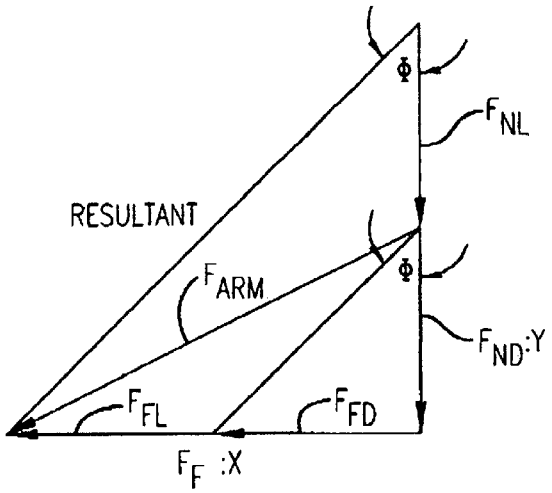

The free body diagram of FIG. 2A and the vector resultant diagram of FIG. 2B together show the relationship of the forces acting on the sheet separator roller. The following notation is used:

$T_D$=Drive Torque $T_L$=Load Torque $F_N$=Total Normal Force $F_F$=Total Friction Force $\mu$=Coefficient of Friction $F_{NL}$=Normal Force portion resulting from static (Load) components $F_{ND}$=Normal Force portion resulting from dynamic (Drive) components $F_{FL}$=Friction Force portion resulting from static (Load) components $F_{FD}$=Friction Force portion resulting from dynamic (Drive) components $\phi$=arctan $\mu$ $\therefore \tan \phi = \mu$ The free body diagram shows a downward force $F_{NL}$ which is an intentionally designed in force dependent on the weight of the pivotally mounted support arm 20, separator roller 10 and other components (12, 14, 16, 18) supported on the arm 20 and dependent upon the pivotal biasing force exerted by the spring 60, if present, which downwardly biases the support arm 20 and separator roller 10. The upwardly directed total normal force $F_N$ is the sum of the intentionally designed in static load normal force $F_{NL}$+the variable dynamic normal force component $F_{ND}$ which is applied through the arm 20 by the separator roller drive. This is schematically shown as a counterclockwise torque $T_D$ in FIG. 1. The total force may be thus considered as the sum of an intentionally applied or static component and a variable or dynamic component exerted by the drive.

The total frictional force $F_F$ is generated in opposition to rotation of the single sheet separator roller 10 and, as is well known, is related to the total normal force $F_N$ by the coefficient of friction $\mu$ which is equal to $F_F/F_N$ when the media is at the verge of slipping.

A force $F_{ARM}$ applied to the separator roller 10 by the support arm 20 is directed along a line between the pivot point 22 of the support arm and the center of rotation of the separator roller 10 since the support arm is considered for analysis essentially as a frictionless link.

The graphical vector resultant of the above forces is shown in FIG. 2B. When the system is on the verge of slipping, the ratio of the total frictional force $F_F=(F_{FL}+F_{FD})$ to the total normal force $F_N=(F_{NL}+F_{ND})$ is the coefficient of friction $\mu$. This results in the upper angle $\phi$ of the diagram being equal to arctan $\mu$.

Since the ratio of the dynamic frictional and normal forces $F_{FD}$ and $F_{ND}$ is also the coefficient of friction $\mu$, the angle $\phi$ (arctan $\mu$) also appears at the top of the lower triangle in FIG. 2B. This is of interest since now the magnitude of the vector $F_{ARM}$ can be determined since its angle is known from the geometry of the embodiment under analysis.

All forces known in order to calculate the gain of the system have now been determined. The gain is expressed by the following relationships:

$$\text{Gain} = \text{Total Drive Force}/\text{Drive Force from Load}$$

$$= \underline{(F_{FL}+F_{FD})}/F_{FL} \text{ and } F_{FL}+F_{FD}\text{: } X \text{ and}$$

$$F_{FL}\text{: } X - F_{FD} = X - Y\tan\phi$$

$$= \underline{X/(X - Y\tan\phi)}$$

$$\text{Gain} = X/(X - Y\mu)$$

From the above relationship it is clear that the gain goes to 1 when Y goes to 0. The self-locking condition, when the separator roller 10 locks against the retard pad 40, is independent of how much drive torque is applied to the roller 40 and occurs when the ratio X/Y is less than $\mu$.

As a result of the above analysis, it is seen that elimination of self-locking and reduction of unmanageably high gain can be accomplished by reducing the distance Y until the gain is reduced to a reasonable level. However, this would likely place the shaft on which the support arm pivots right in the middle of the stack of media which is clearly an unworkable solution. Accordingly, prior art systems with pivoting support arms generally have sub-optimal, if not at times unworkable, gain and self-locking conditions.

Figure 3:
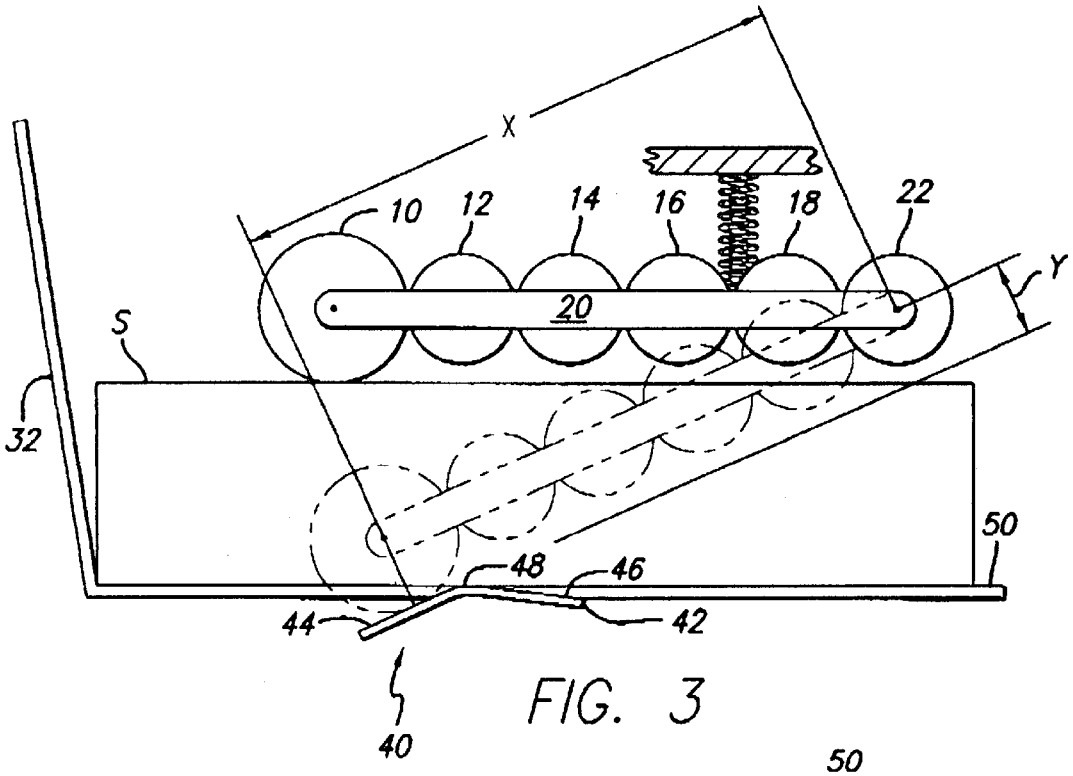
FIG. 3 is a schematic side elevation view of a single sheet feeder with an angled retard pad according to the present invention.

The invention as shown in FIG. 3 solves the problem by allowing easy manipulation of the ratio of X and Y while still allowing the leading edge 42 of the multi-sheet retard pad 40 to be recessed below the uppermost surface of the input stack support tray 50. As shown, pursuant to the invention, the sheet retard pad 40 has a sheet engaging friction surface which includes a downwardly inclined portion 44 which extends downwardly from the surface on which the stack is supported, the sheet separator roller 10 being arcuately movable toward the downwardly inclined portion 44 of the retard pad. Preferably, the downwardly inclined portion 44 of the pad is straight. It is also preferable that the downwardly inclined portion 44 of the sheet retard pad be planar to ensure that the ratio S/Y remains constant rather than convexly or concavely curved although various workable configurations will be apparent to those skilled in the art.

In the preferred arrangement, the sheet retard pad 40 further includes an upwardly inclined portion 46 having an end which is recessed below the support surface of tray 50 to prevent the stack from catching during loading and a rounded peak 48 is provided between the upwardly inclined surface portion 46 and the downwardly inclined surface portion 44 of the retard pad. It should be noted that a unitary gain exists when the dimension Y equals zero. The dimension Y can be made to approach 0 by lowering the pivot point 22 of the support arm 20 toward the stack S and/or by adjusting the angle of the downwardly extending portion 44 of the sheet retard pad. Adjustment of the angle of the downwardly inclined portion 44 of the retard pad is far preferable to lowering the pivot point 22 toward the stack S. A unitary gain is not necessarily always desired as a manageable amount of positive gain is desirable in various conditions. If the media being handled has above average sheet-to-sheet surface friction, a positive gain requires application of more driving force and power whereas media with lower surface-to-surface friction requires less power. Accordingly, it is contemplated that the power requirement for rotating the separator roller 10 can be adjusted depending on the characteristics of the media to be separated. The desired gain can be adjusted by changing the angle of the downwardly inclined surface portion 44.

Figure 6:
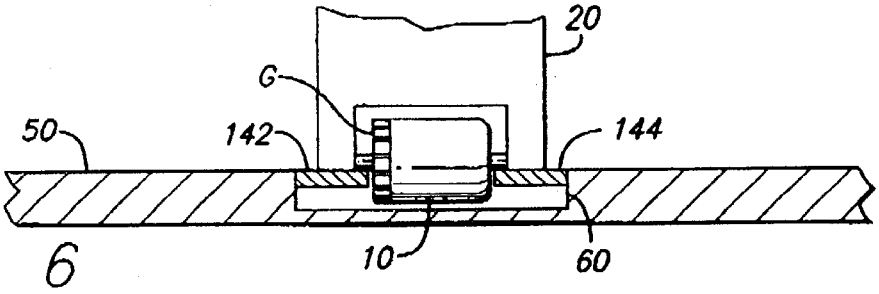
FIG. 6 is a schematic front sectional elevation view of the second embodiment taken at line 6—6 in FIGS. 4 and 5.
Figure 4:
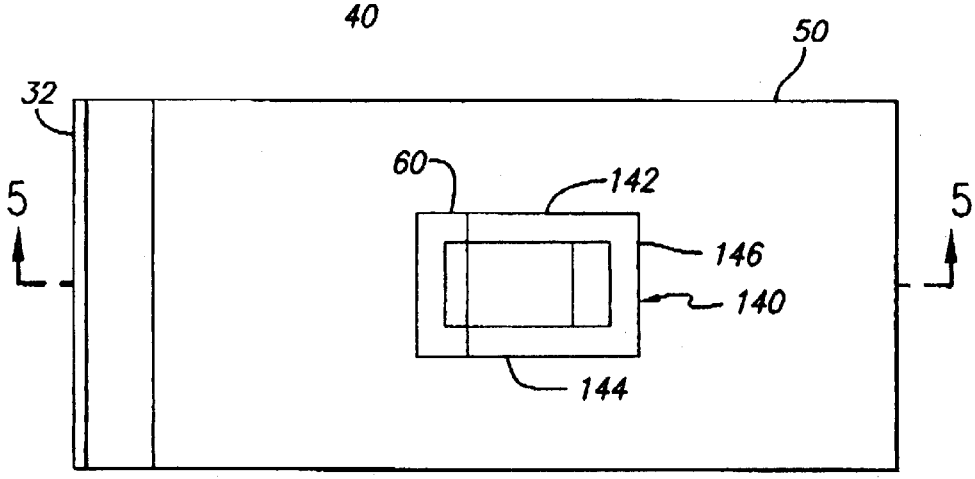
FIG. 4 is a top plan view of the stack support tray showing a second embodiment of the invention.
Figure 5:
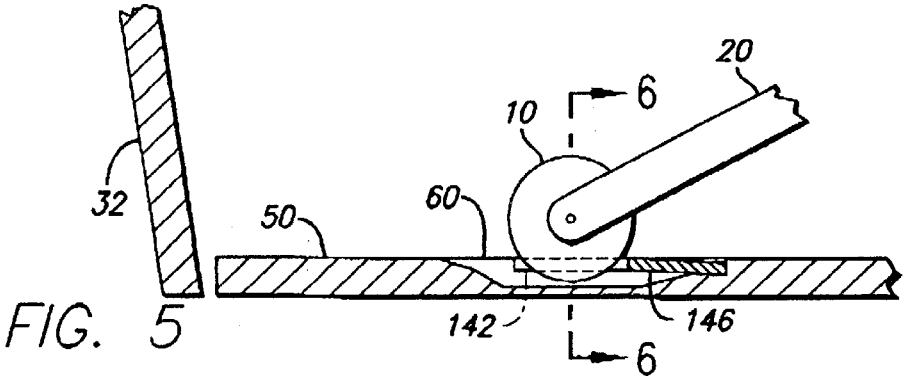
FIG. 5 is an enlarged schematic sectional side elevation view taken at line 5—5 of FIG. 4.

Turning now to the second embodiment shown in FIGS. 4, 5 and 6, the stack support tray 50 has a generally flat upper stack support surface in which a recess 60 is formed. As shown, the recess is of generally rectangular configuration and receives a generally U-shaped retard pad 140 which may be formed of cork or elastomeric material such as rubber. The retard pad 140 has a pair of spaced arms 142, 144 integrally formed with an upwardly inclined (in the direction of media movement) bottom or base 146 such that the upper surface of the retard pad arms 142, 144 extends slightly above the support surface of the stack support tray 50. The proportions shown on FIG. 5 are exaggerated for clarity in which it can be seen that the leading edge of the base 146 of the retard pad is slightly lower than the stack supporting surface of the tray 50 to insure that, during stack loading, the leading edge of the lower sheets in the stack do not come into contact with an edge of the base 146 of the retard pad which inadvertently might otherwise project slightly above the stack support surface.

The roller 10 is axially supported for rotary movement between spaced end portions of the arcuately movable roller support arm 20, the roller 10 being driven by a gear G forming part of the gear train 12, 14, 16, 18 previously described.

As best seen in FIGS. 5 and 6 after the last sheet of media has been driven by the roller 10 from the stack, the spring bias of the support arm 20 causes the roller 10 to drop into the recess 60 between the lower edges of the spaced ends of the roller support arm 20 which come into contact with the upper support surface of the tray 50 or, as is preferable, with the spaced legs 142, 144 of the retard pad 140 which comprise part of the stack support surface. By eliminating direct contact between the roller 10 and the stack support 50 due to provision of the recess 60, the empty-tray roller drive torque load is reduced to near 0 and drive motor stalling which would otherwise occur if the driven roller 10 were biased into contact with the media support surface of the tray and/or retard pad is avoided.

The generally U-shaped configuration of the retard pad 140 provides support for the last media sheet on three sides around the recess and thereby effectively restrains motion of the last sheet until the sheets above it have been moved to prevent multi-sheet picks. Also, the downward biasing force of the spring 60 which urges the roller 10 toward the stack may be significantly reduced from prior designs to avoid any deformation or damage to the last sheet of media which may occur particularly when thin media is loaded in the stack. Those skilled in the art will appreciate that other configurations of the sheet retard pad 140 can be made and that the arresting of arcuate motion of the roller 10 may be by contact of the roller support arm 20 with any suitable portion of the single sheet feeder chassis structure including the stack support surface of the tray 50 and/or the upper media support surface of the retard pad 140.

Persons skilled in the art will also appreciate that various additional modifications can be made in the preferred embodiments shown and described above and that the scope of protection is limited only by the wording of the claims which follow.

What is claimed is:

1. A single sheet feeder for moving individual sheets from the top of a stack thereof comprising: a support surface for said stack, a driven sheet separator roller having an annular sheet engaging friction surface, a last sheet retard pad in said support surface in opposed relationship to said friction surface for retarding movement of the bottom sheet in the stack to minimize multi-sheet picks, and a roller support pivotally connected to chassis structure, said separator roller being rotatably mounted on said roller support and said separator roller being moveable and biased toward said support surface and said sheet retard pad, said sheet retard pad having a sheet engaging friction surface including a portion downwardly inclined from the direction of movement of sheets from said stack, said sheet separator roller being arcuately moveable toward said downwardly inclined portion of said retard pad.

2. The single sheet feeder of claim 1, wherein said downwardly inclined portion is straight.

3. The single sheet feeder of claim 2, wherein self locking of the driven roller by direct contact with the retard pad after passage therebetween of the bottom sheet in the stack is avoided by conforming the geometry of the feeder to the equation $X/Y < \mu$ in which X is the distance between the contact point of the separator roller with the retard pad along a direction co-linear with the downwardly inclined portion of the retard pad and a line orthogonal to the direction in which the distance X is determined that passes through the pivot point of the support arm, Y is the distance orthogonal to X to the pivot point of the support arm and $\mu$ is the coefficient of friction of the downwardly inclined portion of the retard pad.

4. The single sheet feeder of claim 3, wherein the distance of the pivot point from said support surface for a stack of sheets is fixed and the distance Y is adjusted by controlling the angle of inclination of said downwardly inclined portion of said retard pad.

5. The single sheet feeder of claim 4, wherein Y is 0.

6. The single sheet feeder of claim 1, wherein said retard pad further includes an upwardly inclined portion having a leading edge recessed below said stack support surface to avoid interference of said retard pad with the leading edges of lowermost sheets in a stack during loading of the stack onto said support surface.

7. The single sheet feeder of claim 6, wherein said sheet engaging surface of said retard pad further comprises a peak between said upwardly inclined portion and said downwardly inclined portion.

8. The single sheet feeder of claim 7, wherein said downwardly inclined portion is planar.

9. The single sheet feeder of claim 8, wherein said upwardly inclined portion is planar.

10. The single sheet feeder of claim 9, wherein said peak is rounded.

11. The single sheet feeder of claim 1, further comprising a spring connected between said roller support arm and said chassis structure for biasing said arm and roller toward said sheet retarding portion of said retard pad.

12. The single sheet feeder of claim 1, further comprising a roller drive operably connected to said sheet separator roller for imparting torque to said roller.

13. A single sheet feeder for moving individual sheets of media from the top of a stack thereof comprising: chassis structure including a media stack support having a stack support surface, a driven sheet separator roller having an annular sheet engaging friction surface, a last sheet retard pad recessed in said support surface and having a sheet engaging friction surface forming part of said support surface positioned proximate said separator roller for retarding movement of the bottom sheet in the stack to minimize multi-sheet picks, and a roller support pivotally connected to chassis structure, said separator roller being rotatably mounted on said roller support and said separator roller being moveable and biased toward said support surface, said stack support surface having a roller reception recess proximate said retard pad, said sheet separator roller being arcuately moveable toward said recess in said stack support surface, and arcuate movement of said roller support and roller being terminated before said roller engages said stack support surface in said recess by contact of said roller support with said chassis structure.

14. The single sheet feeder of claim 13, wherein said arcuate movement of said roller support is terminated by contact of said roller support with said retard pad.

15. The single sheet feeder of claim 14, wherein said retard pad is of generally U-shaped configuration having a pair of spaced arms and said arcuate movement is terminated by contact of said roller support with said arms.

16. The single sheet feeder of claim 15, wherein said retard pad includes an upwardly inclined portion having a leading edge recessed below said stack support surface to avoid interference of said retard pad with the leading edges of lowermost sheets in a stack during loading of the stack onto said support surface.

17. The single sheet feeder of claim 16, wherein said upwardly inclined portion is planar.

18. The single sheet feeder of claim 17, further comprising a spring connected between said roller support arm and said chassis structure for biasing said arm and roller toward said sheet support.

19. The single sheet feeder of claim 18, further comprising a roller drive operably connected to said sheet separator roller for imparting torque to said roller.

* * * * *

UNITED STATES PATENT AND TRADEMARK OFFICE

CERTIFICATE OF CORRECTION

PATENT NO. : 6,382,620 B1
DATED : May 7, 2002
INVENTOR(S) : Gaarder et al.

It is certified that error appears in the above-identified patent and that said Letters Patent is hereby corrected as shown below:

Title page,
Item [57], ABSTRACT,
Line 18, "stack. support" should read -- stack support --;

Column 1,
Line 53, "angle a" should read -- angle *a* --;

Column 3,
Lines 29-30 and 35-36, "(Drive)
components" should read -- (Drive) components --.

Signed and Sealed this

Sixth Day of July, 2004

JON W. DUDAS
*Acting Director of the United States Patent and Trademark Office*